United States Patent [19]

Fawdry

[11] Patent Number: 4,486,006

[45] Date of Patent: Dec. 4, 1984

[54] SELF-LEVELLING VEHICLE SUPPORT ARRANGEMENT

[76] Inventor: John A. Fawdry, 10, Somerville Rd., Sutton Coldfield, West Midlands, United Kingdom

[21] Appl. No.: 385,378

[22] PCT Filed: Sep. 23, 1981

[86] PCT No.: PCT/GB81/00198

§ 371 Date: May 26, 1982

§ 102(e) Date: May 26, 1982

[87] PCT Pub. No.: WO82/01183

PCT Pub. Date: Apr. 15, 1982

[30] Foreign Application Priority Data

Oct. 1, 1980 [GB] United Kingdom ..... 8031719

[51] Int. Cl.[3] ..... E02C 3/00

[52] U.S. Cl. ..... 254/88

[58] Field of Search ..... 254/88, 90, 94; 187/8.41, 8.67

[56] References Cited

U.S. PATENT DOCUMENTS

| | | | |
|---|---|---|---|
| 1,187,358 | 6/1916 | Marshall | 254/88 |
| 1,193,451 | 8/1916 | Blee | 254/88 |
| 1,527,901 | 2/1925 | Munday | 254/88 |
| 3,326,525 | 6/1967 | Kauppi | 254/88 |

FOREIGN PATENT DOCUMENTS

| | | |
|---|---|---|
| 1058318 | 3/1954 | France . |
| 364202 | 1/1932 | United Kingdom . |
| 415188 | 8/1934 | United Kingdom . |
| 517929 | 2/1940 | United Kingdom . |
| 1376275 | 12/1974 | United Kingdom . |

*Primary Examiner*—Robert C. Watson

*Attorney, Agent, or Firm*—Cushman, Darby & Cushman

[57] ABSTRACT

A self-levelling vehicle support arrangement is provided in which a pair of side-by-side tracks (1) are arranged to pivot in a controlled manner from inclined ramp positions into elevated horizontal positions under the weight of a vehicle (20) moved fully onto the tracks (1). In one embodiment each track (1) is pivoted intermediate its ends on a respective stand (2) and control of the pivoting of the tracks (1) is effected by telescopic dampers (5, 6) extending between the ground and the tracks (1). Preferably telescopic damper (6) are provided adjacent the ends of the tracks (1) which are uppermost when the latter are inclined, these dampers (6) being arranged to be fully contracted when the tracks (1) are horizontal and thereby serving, together with the stands (2), to carry the weight of a vehicle (20) on the tracks (1).

5 Claims, 3 Drawing Figures

SELF-LEVELLING VEHICLE SUPPORT ARRANGEMENT

The present invention relates to a self-levelling vehicle support arrangement for use, for example, during the inspection and maintenance of a motor vehicle.

Owing to the small clearance which exists between the underside of a vehicle and the ground, it is generally necessary to lift the vehicle up off the ground to enable proper inspection and maintenance of the vehicle underside. Known means for lifting vehicles off the ground include hydraulically operated platforms and such platforms have found widespread use in commercial garages. However, owing to their cost and dependence on an external power source, hydraulic platforms are unsuitable for many applications, for example where there is only an occasional requirement to raise a vehicle or in garages in developing countries. Of course, simpler vehicle elevating means are also known, such as a pair of ramps onto which the front wheels of a vehicle can be run to elevate the front part of a vehicle; however, such means generally only raise part of the vehicle and provide very little working space beneath the vehicle.

It is an object of the present invention to provide a vehicle elevating arrangement which is simple in form, does not require an external power source, and is inexpensive to manufacture, while at the same time, enables a vehicle to be raised with ease to a convenient, level, working position.

According to the present invention, there is provided a self-levelling vehicle support arrangement comprising a vehicle-carrying track structure, first support means pivotally mounting the track structure intermediate its ends at such a position that the track structure is arranged to pivot from an inclined position into an elevated horizontal position under the weight of a vehicle moved fully onto the track structure, second support means spaced from said first support means and positioned on the side thereof nearest the end of the track structure which is highest when the latter is in its inclined position, the first and second support means together serving to support the track structure when the latter assumes a horizontal position under the weight of a vehicle, and pivotal-movement control means arranged to ensure that the pivoting of the track structure between its inclined and horizontal positions is effected in a controlled manner.

The track structure is kept in its horizontal position by the weight of the vehicle throughout inspection and maintenance of the vehicle. When work on the vehicle has been completed, it can simply be moved back along the track structure to enable the latter to be returned in a controlled manner to its normal inclined position.

Advantageously, the track structure comprises two spaced side-by-side tracks, the first and second support means being constituted by respective supports associated with each track.

Preferably, for each track, both the corresponding second support and the means controlling the pivotal movement of the track are constituted by the same telescopic damper, the damper being in an extended state when the track is horizontal.

Each track can be provided with a further telescopic damper extending between the ground and the track at a position spaced from the first support on the side thereof remote from the second support, this damper being arranged to be in a contracted state when the track is inclined and in an extended state when the track is horizontal.

For safety reasons, it is desirable to provide each track with a stabilising leg pivoted on the track adjacent its end which is lowermost when the track is inclined. This leg is arranged to swing down and lock the track in position when horizontal.

The vehicle support arrangement can be mounted on wheels to provide a trailer towable, for example, behind a breakdown vehicle.

A self-elevating vehicle support arrangement embodying the invention will now be particularly described, by way of example, with reference to the accompanying diagrammatic drawings, in which.

Figure 1:
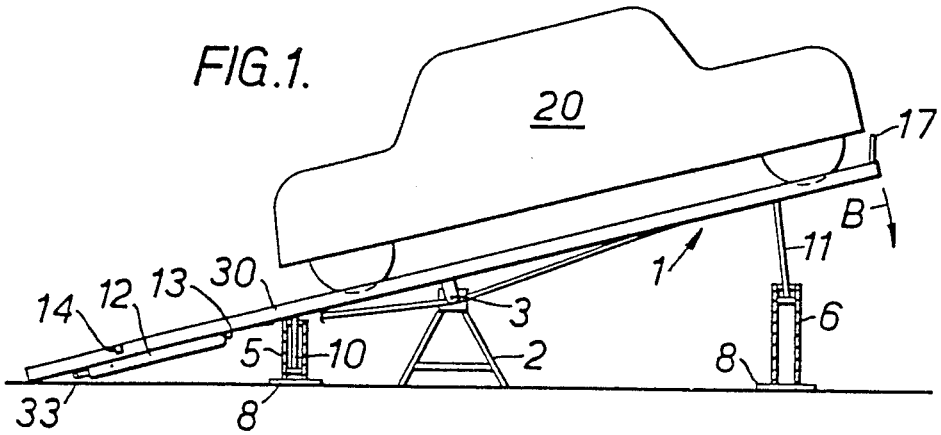
FIG. 1 is a side elevation of the vehicle support arrangement shown at is starts to pivot from an inclined to a horizontal position under the weight of a vehicle, telescopic dampers of the vehicle support arrangement being shown in section.

As shown in the drawings, the self-elevating vehicle support arrangement comprises a vehicle-carrying track structure in the form of two tracks 1 which are pivotally mounted in parallel side-by-side relation on respective supports in the form of stands 2. Each track 1 comprises two spaced longitudinally-extending members 30 joined by a plurality of angle-iron cross-pieces 31. Each stand 2 is of frame construction and rigidly carries a pivot pin 3 at its upper end. This pin 3 is pivotally engaged by a pivot tube rigidly connected to the corresponding track 1. The axes of pivoting A—A of the two tracks 1 are coincident and lie substantially midway between the track ends. The right-hand end of each track 1 (as viewed in the drawings) is closed by a stop plate 17.

Figure 2:
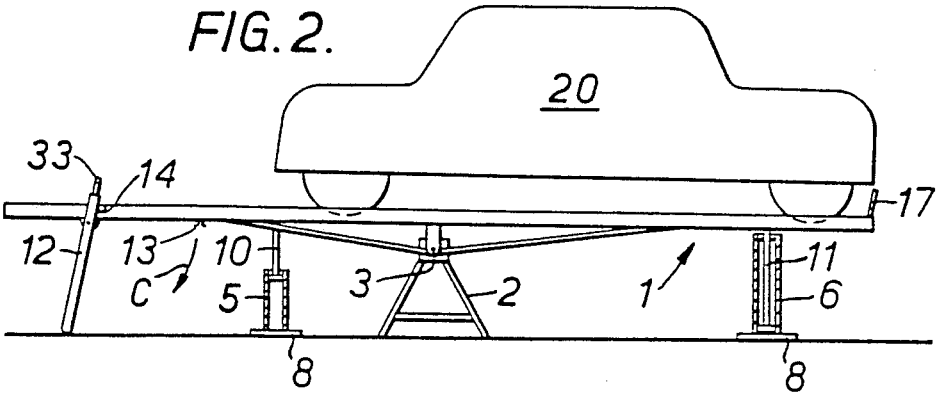
FIG. 2 is a view similar to FIG. 1 but showing the vehicle support arrangement in its horizontal position.
Figure 3:
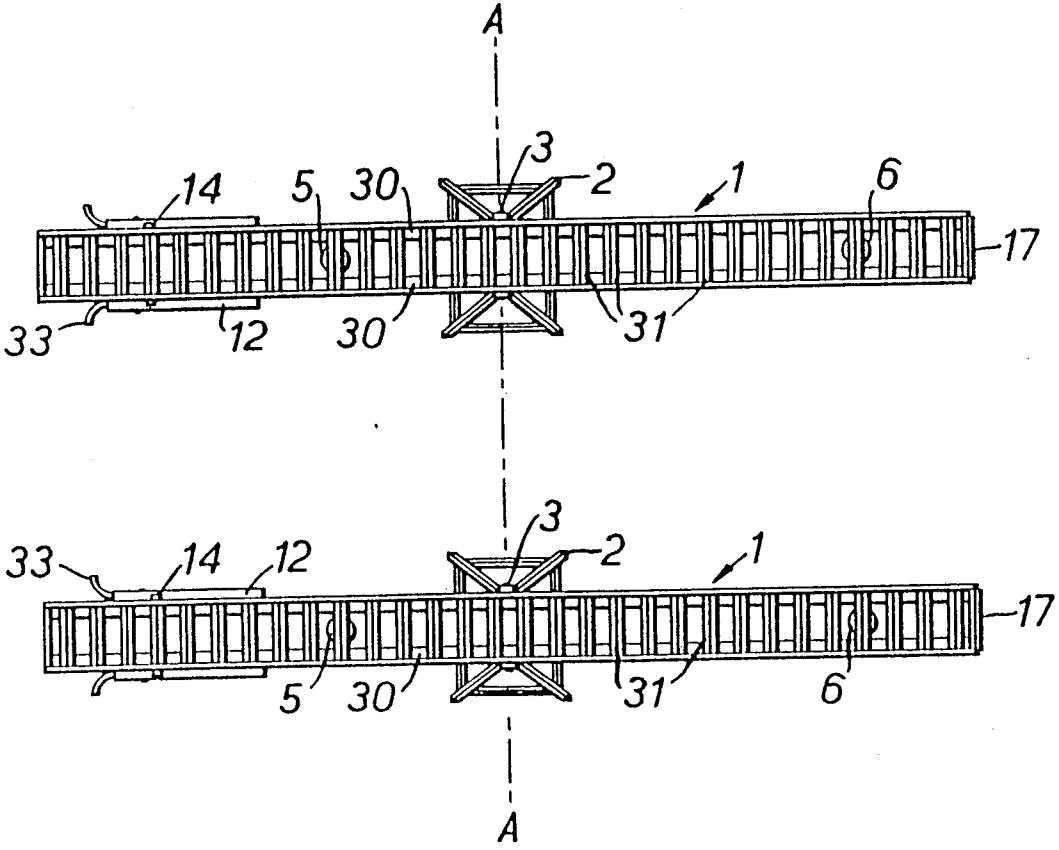
FIG. 3 is a plan view of the vehicle support arrangement.

Associated with each track 1 are two vertically-orientated hydraulic dampers 5 and 6 of telescopic piston-cylinder construction, the damper 5 being arranged to the left of the stand 2 (as viewed in FIGS. 1 and 2) and the damper 6 to the right.

Although generally unnecessary, if desired the dampers 5 and 6 may be fixed relative to the stands 2 by means of flat strip tie bars (not shown) connected between the stands 2 and the bases 8 of the dampers 5 and 6; similarly transverse flat strip tie bars can be provided to connect each of the dampers 5 and 6 associated with one track 1 with the corresponding damper of the other track 1. The tracks 1 could if desired, be likewise interconnected by tie rods (not shown). Where transverse connections are provided, they are preferably adjustable in length to enable different vehicle track widths to be accommodated.

The piston rod 10 of each hydraulic damper 5 is connected to the underside of the corresponding track 1 in such a manner as to allow for the slight change in distance which occurs between the pivot axis A—A and the point of intersection of the vertical piston rod 10 and the track 1 upon pivotal movement of the latter; thus, for example, the upper end of the piston rod 10 can be slidably connected to the track 1 for movement lengthwise of the track during pivoting of the latter. The piston rod 11 of each damper 6 is similarly connected to the underside of the corresponding track 1. In most practical applications of the vehicle support arrangement, mechanical provision for the above-mentioned distance change which occurs upon pivoting of the tracks, has proved unnecessary, slight tilting of the dampers 5 and 6 being acceptable.

The tracks 1 are arranged to pivot between an inclined, ramp position (see FIG. 1) in which the left hand end of each track 1 touches the ground, and a horizontal inspection position (see FIG. 2); as will be more fully described hereinafter, this pivotal movement (see arrow B in FIG. 1) is brought by the weight of a vehicle 20 driven onto the tracks 1. In the absence of a vehicle upon the tracks 1, the balance of these tracks 1 is arranged to be such that they reside in their inclined position.

In the inclined position of the tracks 1, the dampers 5 are fully contracted whereas the dampers 6 are fully extended. Conversely, in the horizontal position of the tracks, the dampers 5 are fully extended while the dampers 6 are fully contracted; indeed the horizontal positions of the tracks 1 is defined by arranging for the dampers 6 to have a height when fully contracted which is equal to the height of the stands 2. With such an arrangement, when the tracks 1 are horizontal, the weight of the tracks and the vehicle supported thereby is borne by the stands 2 and the fully-contracted dampers 6 acting as support means.

In an alternative construction (not shown) the horizontal positions of the tracks 1 are defined by rigid support means which engage the right-hand end of the tracks 1 (as viewed in FIG. 1) as the latter move into their horizontal positions; the tracks 1 are thus supported when horizontal by the stands 2 and the rigid support means, the dampers 6 being unloaded. Since in this construction the dampers 6 do not act as support means, there is no need for these dampers to be fully contracted when the tracks 1 are horizontal.

Each damper 5, 6 may incorporate a one-way valve which opens to permit rapid extension of the damper but which closes to damp the contraction of the damper under the influence of the weight of a supported vehicle. With such an arrangement, the dampers 6 damp movement of the tracks into their horizontal positions whereas the dampers 5 damp movement of the tracks into their inclined positions.

A respective U-shaped stabilising leg 12 is pivoted to each track 1 to the left of the damper 5 (as viewed). This leg 12 is retained in a stowed position by a spring clip 13 when the track 1 is in its inclined position; upon the track 1 being moved into its horizontal position, the leg 12 is swung down (see arrow C in FIG. 2) and taken slightly past the vertical into an operative position defined by a stop 14 carried by the track 1. The length of each leg 12 is such that with the tracks 1 horizontal, movement of the leg 12 through its vertical position raises the adjacent portion of the corresponding track 1 slightly above the level at which it would normally reside in its horizontal position; this raising movement is enabled by resilience in the track. As a result of this arrangement, the legs 12 are positively retained in their operative positions ensuring that the tracks 1 cannot accidently incline. To facilitate movement of the legs 12 through their vertical positions, handles 33 are provided on the legs 12.

Each stabilising leg 12 can be provided with an associated stop plate (not shown) rigid therewith, this plate being arranged to lie flat against the upper surface of the corresponding track 1 when the leg 12 is held in its retaining clip 13. Upon the leg 12 being swung down into its operative position, the stop plate sits up from the track 1 to prevent the vehicle 20 from moving leftwards (as viewed) off the tracks 1.

Use of the self-elevating vehicle support arrangement will now be described.

Initially, the tracks 1 will be in an inclined position with the legs 12 stored and the dampers 6 fully extended. In this position, vehicle 20 can be driven (or pulled by suitable tackle) fully onto the tracks 1 such that the centre of gravity of the vehicle is to the right of the pivot axis A—A (as viewed in FIG. 1). The weight of the vehicle 20 now acts to upset the balance of the tracks 1 and causes them to move in the direction of arrow B. This movement is inhibited at least by the contracting dampers 6 (and possibly also by the expanding dampers 5) so that the vehicle 20 is gently moved into an elevated horizontal position. When the tracks 1 have moved into their horizontal positions, the legs 12 are moved into their operative positions. The underside of the vehicle 20 can now be conveniently and safely inspected and, if necessary, worked upon.

To move the vehicle 20 off the tracks 1, simply requires the legs 12 to be stowed and the vehicle 20 to be shifted into a position in which its weight causes the tracks 1 to return to their inclined positions.

The tracks 1 are preferably made dismountable from their stands 2 to facilitate stowage, the dampers 5 and 6 either being arranged to swing up parallel to the tracks during stowage or being disconnectable therefrom.

Various modifications can, of course, be made to the described vehicle support arrangement. Thus, for example, further safety means can be provided to mechanically lock the dampers 5 in their fully extended positions during inspection and maintenance of a vehicle 20 on the tracks 1. Furthermore, the telescopic dampers 5 and 6 of each track could be hydraulically interconnected such that damping is effected by the passage of hydraulic fluid from the contracting to the expanding damper rather than by the passage of fluid past the piston in each damper; it would, of course, be possible to hydraulically interconnect all four dampers together rather than just in pairs.

Instead of the telescopic dampers 5 and 6, other damping means could be used. Thus, a circular motion damper could be arranged to directly damp pivotal movement of the track pivot tube relative to the pivot pin 3. With such an arrangement rigid support means would be necessary to define the horizontal position of the tracks in a manner already described.

In all the vehicle support arrangements described hereinbefore, the tracks 1 have been arranged to pivot automatically from their inclined to horizontal positions as a vehicle is moved fully onto the tracks, this pivoting being controlled by damping means. However, it is also possible to arrange for the pivoting movement of the tracks to be controlled by manually operable lowering means operated subsequent to the vehicle being moved fully onto the tracks. Such manually operable lowering means can comprise a controllable damper, friction brake, screw arrangement or any other suitable device.

Any of the hereinbefore described forms of vehicle support arrangement can be mounted on wheels to provide a trailer towable, for example, behind a breakdown vehicle. Thus with reference to the illustrated vehicle support arrangement, each stand 2 and each damper 6 could be provided with a pair of wheels, the dampers 5 either being dispensed with entirely or being suitably stowed during towing. The two track assemblies are preferably connected to a towing vehicle by a suitable towing frame connected to one end of each track in a manner enabling the spacing of the tracks to be set as desired.

I claim:

1. A self-elevating vehicle support arrangement comprising two pivotally-mounted tracks (1) arranged side-by-side in spaced parallel relation, a respective stand (2) pivotally mounting each track (1) intermediate the ends thereof at such a position that the track (1) is arranged to pivot from an inclined ramp position into an elevated horizontal position under the weight of a vehicle (20) moved fully onto the tracks (1), support-stop means (6) disposed on the side of the stands away from the ends of the tracks which contact the ground when the tracks (1) are in their inclined ramp position, said support-stop means (6) being arranged to prevent the tracks (1) pivoting past their said horizontal positions as a vehicle (20) is moved onto the tracks (1) and serving, together with said stands (2), to support the weight of the vehicle when the tracks (1) are in their horizontal positions, and telescopic damping means (5, 6) extending between the tracks (1) and the ground and serving to damp pivotal movement of the tracks (1), characterised in that:

the said telescopic damping means comprises two telescopic damping arrangements (5, 6) connected to the tracks (1) on respective sides of, and spaced from, the stands (2) whereby, independently of the sense of pivoting of the tracks (1), track movement is damped by the downward telescoping of a said damping arrangement (5, 6), the overall vehicle support arrangement is free standing with the ground-contacting portions (8) of the damping arrangements (5, 6) being connected to the corresponding stands (2) only through the associated track (1).

2. An arrangement according to claim 1, wherein said support-stop means comprises a respective support stop (6) associated with each track (1) and the two said damping arrangements (5, 6) each comprise two dampers connected to respective ones of the tracks (1), each track (1) and its associated stand (2), dampers (5, 6) and support stop (6) being physically independent from the other track (1) and its associated elements whereby adjustment in spacing between the tracks (1) and stowage of the vehicle support arrangement is facilitated.

3. An arrangement according to claim 2, wherein the tracks (1) are dismantlable from their corresponding stands (2) for stowage.

4. An arrangement according to claim 2 or claim 3, wherein said support stops are constituted by the dampers (6) connected to the tracks (1) on the side of the stands (2) away from the ends of the tracks which contact the ground when the tracks (1) are in their inclined ramp positions, the dampers (6) constituting the support stops being fully contracted when the tracks (1) are horizontal.

5. An arrangement according to claim 1, wherein each track (1) is provided with a stabilising leg (12) pivotally mounted on the track (1) adjacent the end thereof which contacts the ground when the track (1) is in its horizontal position, said leg (12) being so arranged that when its associated track (1) is horizontal, the leg (12) can be pivoted into an operative position in which it serves to stabilise the track (1), by being manually displaced just past its dependent vertical position to engage an abutment (14) rigid with the track (1), the leg (12) when in said vertical position raising the adjacent track portion slightly above the level at which it would reside if supported solely by the stand (2) and the said support stop means (6).

* * * * *